United States Patent [19]

Takeuchi

[11] Patent Number: 4,743,227

[45] Date of Patent: May 10, 1988

[54] COLUMN FOR CONTINUOUS PARTICLE FRACTIONATION APPARATUS UTILIZING CENTRIFUGAL FIELD

[75] Inventor: Makoto Takeuchi, Tokyo, Japan

[73] Assignee: JEOL Ltd., Tokyo, Japan

[21] Appl. No.: 62,155

[22] Filed: Jun. 12, 1987

[30] Foreign Application Priority Data

Jun. 17, 1986 [JP] Japan ..... 61-141154
Nov. 27, 1986 [JP] Japan ..... 61-182443

[51] Int. Cl.[4] ..... B04B 1/04
[52] U.S. Cl. ..... 494/85; 494/45
[58] Field of Search ..... 494/85, 18, 21, 35, 494/38, 45; 210/781, 782, 360.1, 360.2, 380.1; 436/45, 177; 285/41

[56] References Cited

U.S. PATENT DOCUMENTS 4,284,497 8/1981 Grant ..... 494/85
4,304,357 12/1981 Schoendorfer ..... 494/21

FOREIGN PATENT DOCUMENTS 2002266 2/1979 United Kingdom ..... 494/21

*Primary Examiner*—Harvey C. Hornsby
*Assistant Examiner*—J. Dwight Poffenberger, Jr.
*Attorney, Agent, or Firm*—Webb, Burden, Robinson & Webb

[57] ABSTRACT

There is disclosed a column for use in a continuous particle separation apparatus utilizing a centrifugal field. The column comprises a column base constituting an outer frame, a spacer having a cutout portion at its center, an intermediate ring having a slot and a variable diameter, and a top ring mounted inside the intermediate ring. The intermediate ring has an inlet port and an outlet port for introducing and discharging fluid near the slot. The intermediate ring has an inclined inner surface. The top ring has an inclined outer surface which is pressed against the inclined inner surface of the intermediate ring to expand the intermediate ring. Thus, the spacer is pressed against the base. A separation channel is formed between the inner wall of the base and the intermediate ring within the cutout portion of the spacer.

6 Claims, 8 Drawing Sheets

COLUMN FOR CONTINUOUS PARTICLE FRACTIONATION APPARATUS UTILIZING CENTRIFUGAL FIELD

FIELD OF THE INVENTION

The present invention relates to a column which is for use in a continuous particle fractionation apparatus utilizing a centrifugal field and which can form an accurate separation channel.

BACKGROUND OF THE INVENTION

When particulates contained in fluid are placed in a centrifugal field, each particulate undergoes a force corresponding to its mass. When this force is larger than the force of self-diffusion, the particulates are separated from the liquid layer to form a solid layer. When the particulates are small, however, they do not settle fully but form a layer at a location where the centrifugal force is balanced by the force of self-diffusion. When fluid flows through a narrow channel, the flow rate of the fluid at the portion where the fluid is in contact with the inner wall of the channel is lower than the flow rate of the central portion. Hence, the distribution of flow assumes a parabolic curve whose vertex is located at the center of the channel. When a centrifugal field is applied perpendicularly to the channel, the particulates in the fluid move at flow rates that are inherent in the positions at which the centrifugal force is balanced by the force of self-diffusion. The technique employing this principle to separate particulates in fluid is known as sedimentation field-flow fractionation (SFFF). Columns used for this fractionation must satisfy the following requirements:

(1) The wall must be made from a chemically inactive material, and must have a high degree of flatness. The roughness of the wall surface must have submicron dimension.

(2) A channel that is used for centrifugal separation must have a width and a height which are accurately uniform in the direction of flow of fluid.

(3) The inlet port of the column must be fully isolated from the outlet port.

(4) There must be no leakage.

(5) The dead volume of the inlet and outlet ports must be minimized.

(6) The column must be easily disassembled and reassembled for cleaning of the inside.

Kirkland and others have made some proposals to meet these requirements.

FIGS. 1(*a*)–1(*c*) show a conventional column for a continuous particle fractionation apparatus making use of a centrifugal field. As shown in FIG. 1(*a*), this column comprises an inner ring 21 and an outer ring 22. The inner ring 21 is provided with an inlet port 23 and an outlet port 24, and is provided with a machined groove 25 at a position located between these ports. The outer surface of the inner ring 21 has a separation groove 25 extending from end to end. Two seal grooves 27 are formed on opposite sides of the separation groove 25. When the column is assembled, a seal material 28 is inserted in the seal grooves 27. Then, the inner ring 21 is inserted into the outer ring 22, as shown in the cross section of FIG. 1(*b*). Thus, a channel 29 is formed in the separation groove 25 which is surrounded by the inner ring 21 and the outer ring 22. A wedge 30 is used to expand the inner ring 21 to couple it to the outer ring 22.

The channel 29 measures 50 to 300 μm in width, 25 mm in height, and 58 cm in length, for example. The dimensions of the cross section of the channel 29 are uniform over its whole length. The inlet port 23 for injecting fluid into the channel 29 and the outlet port 24 for taking the fluid out of the channel 29 are disposed very close to each other at both ends of the channel 29. The arrangement of the inlet port 23, the outlet port 24, the separation groove 25, and the seal grooves 27 is shown in FIG. 1(*c*).

To effect sedimentation field-flow fractionation, fluid is passed through the channel 29 of the column as shown in FIGS. 1(*a*)–1(*c*) at a flow rate of 1 ml/min. The total capacity of the channel 29 is about 3 ml. If the liquid leaks from the column, forming a bypass passage, then the peak appearing on an obtained graph will deviate from its correct location or will not indicate a correct value. The sample which moves at a rate slower by two orders of magnitude than the average flow rate of the fluid flowing through the column is spaced a distance of the order of microns from the wall surface. Accordingly, if the wall surface has roughness of the order of microns, then the analytical accuracy is greatly affected. For these reasons, it is important for the column used for sedimentation field-flow fractionation to prevent leakage of liquid, to secure a seal pressure and to secure high accuracy in machining the surface of the channel 29.

However, the conventional column requires highly sophisticated machining techniques to machine the channel surface accurately and to prevent leakage of liquid, because the separation groove constituting the channel as shown in FIGS. 1(*a*)–1(*c*) is formed in the outer surface of the inner ring. Another problem is that it is difficult to assemble the column, because the difference between the outside diameter of the inner ring and the inside diameter of the outer ring is quite small.

SUMMARY OF THE INVENTION

It is a main object of the present invention to provide a column which is used for a continuous particle separation apparatus which utilizes a centrifugal field and which is easy to manufacture or assemble.

It is another object of the invention to provide a column which is used for a continuous particle separation apparatus and which utilizes a centrifugal field, which is capable of easily securing a desired seal pressure, and which can effectively prevent leakage of liquid when the column is at rest.

It is a further object of the invention to provide a column which is used for a continuous particle separation apparatus which utilizes a centrifugal field and which permits the wall surface of the channel, especially the accumulation wall, to be replaced with another easily.

Briefly according to this invention, an annular column is used for continuous particle separation using a centrifugal field. A column base constitutes an outer frame having a cylindrical flange. A ribbon-like spacer has a cutout portion at its center to define axial walls of a channel. An intermediate ring has a variable diameter and an inclined inner surface. The ring is radially cut to form a circumferential slot such that when the spacer is captured between the base and intermediate ring an annular channel is formed. An inlet port and an outlet port are formed in the intermediate ring near the slot to introduce and discharge fluid to the channel. A tightening ring has an inclined outer surface and is mounted inside the intermediate ring. The inclined outer surface of the tightening ring is pressed against the inclined inner surface of the intermediate ring to expand the intermediate ring for pressing the spacer against the base. The separation channel is thus formed between the inner wall of the base and the outer wall of the intermediate ring within the cutout portion of the spacer.

BRIEF DESCRIPTION OF THE DRAWINGS

FIG. 1(*b*) is a fragmentary vertical cross section of the column shown in FIG. 1(a);

FIG. 1(*c*) is another fragmentary vertical cross section of the column shown in FIG. 1(*a*);

DESCRIPTION OF THE PREFERRED EMBODIMENT

Figure 1:
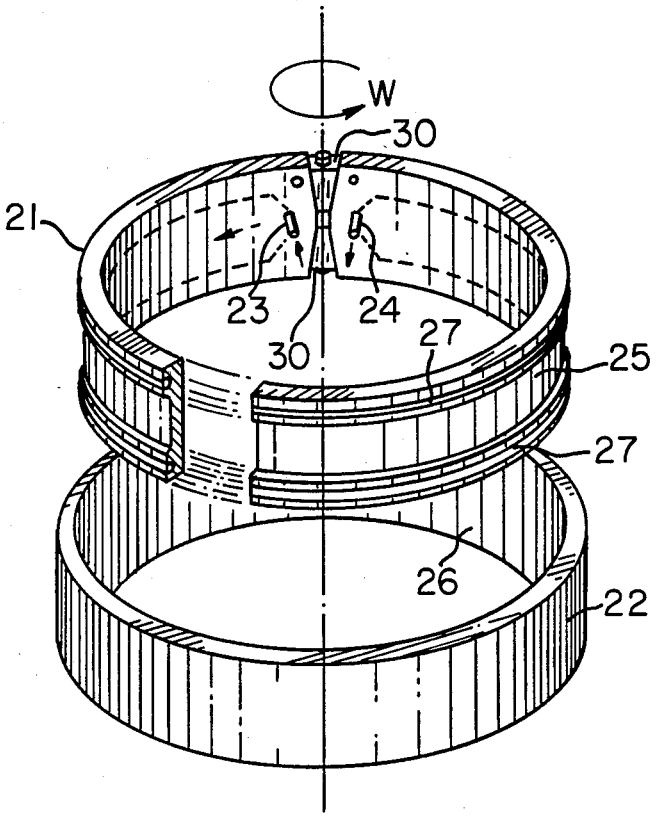
FIG. 1(*a*) is an exploded perspective view of a conventional column.
Figure 1:
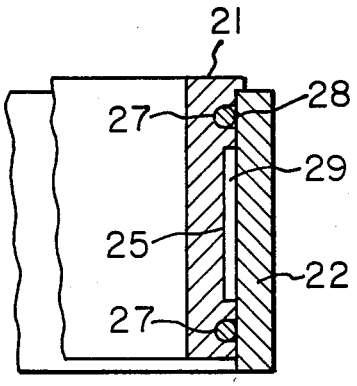
Figure 1:
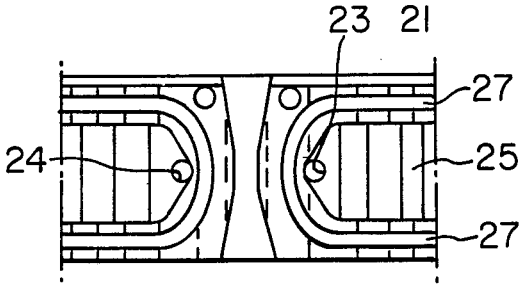
Figure 2:
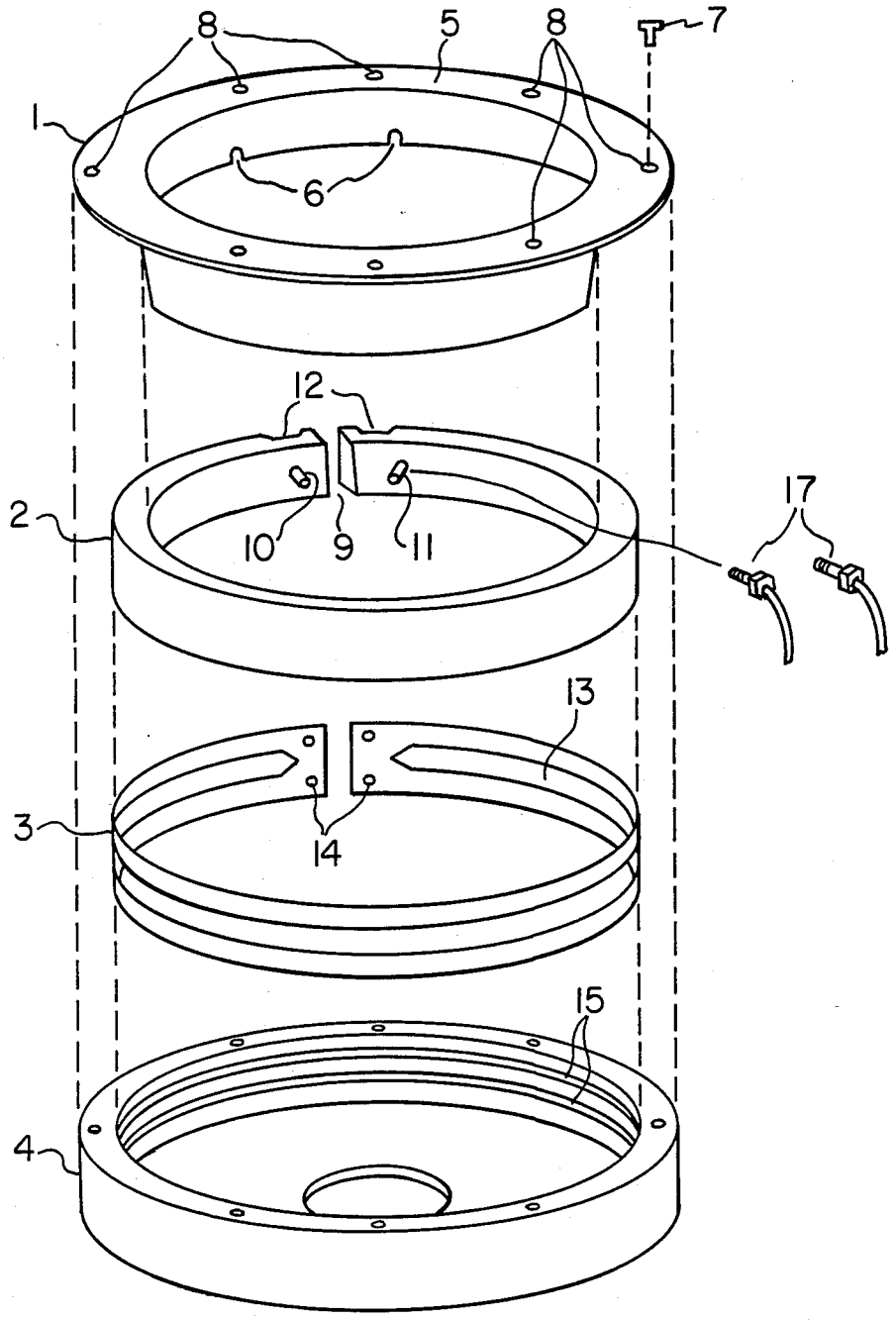
FIG. 2 is an exploded perspective view of a column according to the invention.
Figure 3:
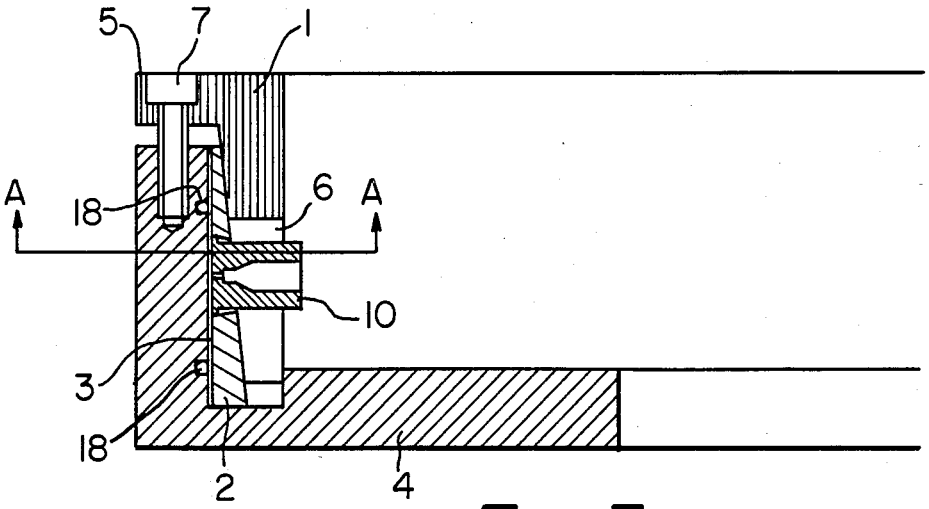
FIG. 3 is a fragmentary vertical cross section of the column shown in FIG. 2.
Figure 4:
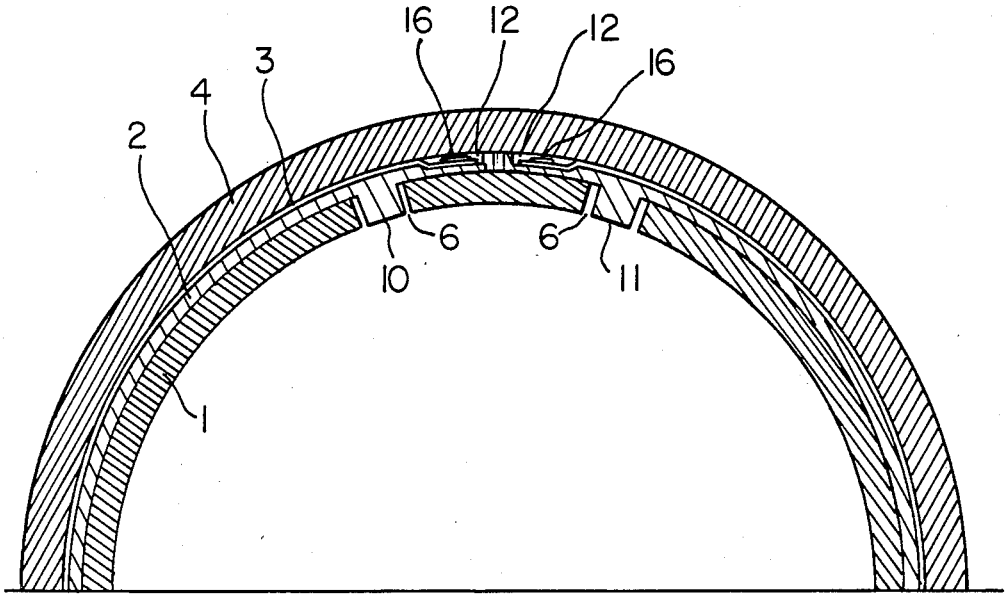
FIG. 4 is a cross-sectional view taken on line A—A of FIG. 3.

Referring to FIGS. 2–4, there is shown a column embodying the concept of the present invention. This column is used for a continuous particle separation apparatus utilizing a centrifugal field. The column comprises a flanged top ring 1 for tightening, an intermediate ring 2 having a variable diameter, a spacer 3, and a column base 4. The top ring 1 is made of aluminum or an aluminum alloy, and has a flange 5. The top ring 1 is so machined that the thickness of the wall decreases downwardly. The top ring 1 has two cutout portions 6 at its lower end. The flange 5 is provided with holes 8 in which bolts 7 are inserted to fix the top ring 1 to the base 4.

The intermediate ring 2 having a variable diameter is made of stainless steel. The ring 2 is cut to form a slot 9. Near both ends of the ring 2, a tube 10 for injecting fluid and a tube 11 for discharging fluid extend through the ring 2. Recesses 12 are formed in the outer surface of the intermediate ring 2 near both ends of the ring 2 so that the spacer 3 may be mounted in the recesses 12. The thickness of the wall of the ring 2 increases downwardly. The flanged ring 1 and the intermediate ring 2 can be made of different metals to minimize the friction between their inclined contact surfaces. It is also possible to coat the contact surface with an antifriction material or particulate Teflon, otherwise, antifriction gasket made of polyimide containing graphite Teflon may be inserted between the contact surfaces.

The spacer 3 consists of a sheet of a polymerized sheet material, say a polyimide, of a given thickness having highly smooth surfaces. The spacer 3 is provided with a cutout portion 13 that has a given width except for its end portions. These end portions taper off toward the positions corresponding to the inlet tube 10 and the outlet tube 11. The spacer 3 also has holes 14 used for mounting near its both ends.

The column base 4 consists of a cylindrical container having a bottom, and is made of stainless steel, for example. The flanged ring 1, the intermediate ring 2, and the spacer 3 are housed in this base 4. The inner surface of the base 4 is polished like a mirror. Seal grooves 15 are formed in the inner surface of the base 4 at a high position and at a low position. O-rings 18 are inserted in the grooves 15, as shown in FIG. 3.

The column is assembled in the manner described below. First, as shown in FIG. 4, the spacer 3 is wound around the outer periphery of the ring 2. Each end of it is inserted into the recess 12 in the intermediate ring 2. Screws 16 are used to fix one end of the spacer and to incompletely fix the other end. Then, the ring 2 is compressed to reduce its diameter. After the compressed ring 2 is inserted into the base 4, the flanged top ring 1 is inserted into the intermediate ring 2. The top ring 1 is tightened against the base 4 by rotating bolts 7. As the inclined surface of the top ring 1 is pressed against the inclined surface of the ring 2, the ring 2 is expanded by the action of the wedge. The whole outer periphery of the intermediate ring 2 is pressed against the inner wall of the base 4 sandwiching the spacer 3 between them. When the top ring 1 is inserted in the intermediate ring 2, the inlet tube 10 and outlet tube 11 extending through the ring 2 are positioned in the cutout portions 6 in the top ring 1. Finally, swage-type connectors 17 are connected to the inlet tube 10 and the outlet tube 11.

As a result, as shown in FIG. 3, the spacer 3 is sandwiched between the intermediate ring 2 and the base 4. The cutout portion 13 and the spacer 3 are used as a channel through which fluid flows. The thickness of the spacer 3 corresponds to the width of the channel. This width is set ranging 50 to 300 μm, for example. The opposed surfaces of the intermediate ring 2 and the base 4 which constitute the channel are polished specularly. The width can be easily set to any desired value by the use of the spacer 3 having an appropriate thickness and the ring 2 fitted for said spacer. Since the spacer 3 is fixed to the ring 2, the inlet and outlet for fluid can be correctly located at the narrowest points of the tapering portions in the cutout portion 13. This permits the slot 9 in the ring 2 to be disposed close to the inlet tube 10 and the outlet tube 11. As a result, the length of the column can be made large.

Figure 5A:
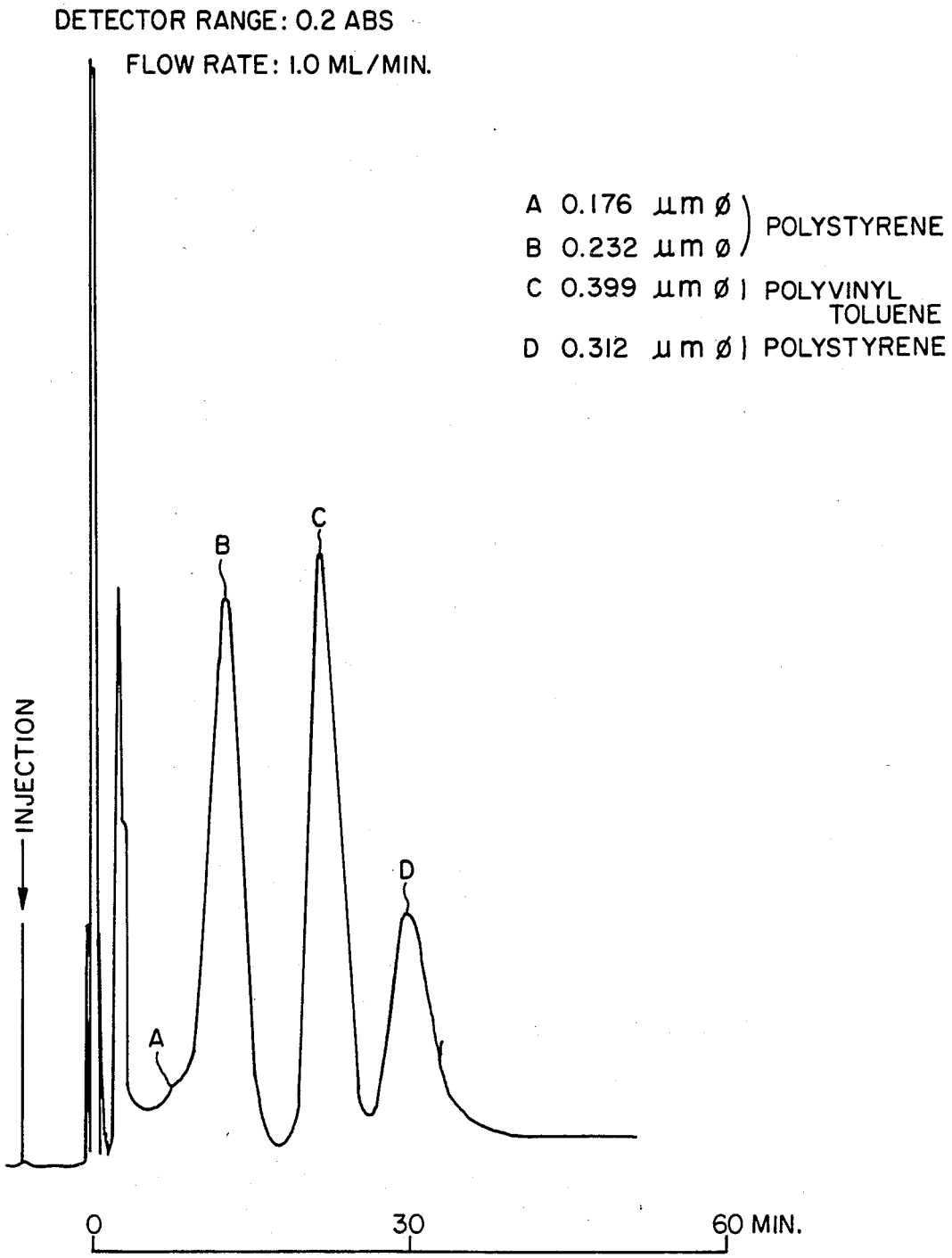
FIGS. 5(*a*) and 5(*b*) are diagrams showing the result of measurements made using the column shown in FIG. 2.
Figure 5B:
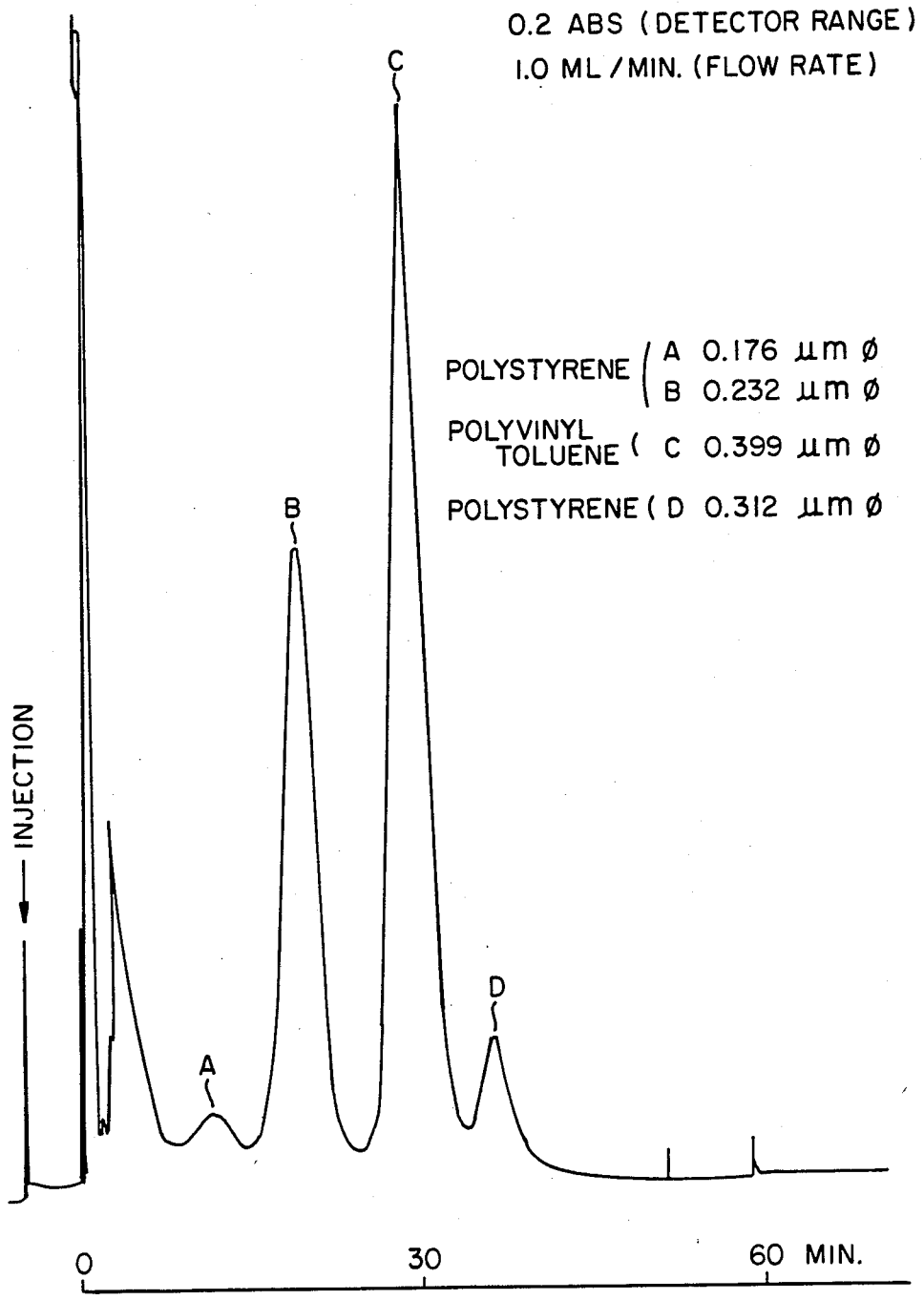

Particles of polystyrene latex having diameters of 0.176 μm, 0.232 μm, and 0.312 μm were mixed with particles of polyvinyl toluene latex having a diameter of 0.399 μm. The obtained mixture was analyzed with the novel column constructed as described above. The graph of FIG. 5(*a*) shows the result of the analysis in which the rotational frequency was maintained at 1,600 rpm. The graph 5(*b*) shows the result of the analysis in which the rotational frequency was reduced exponentially from 1,900 rpm. It can be seen from these graphs that good separation was achieved in a short period.

As can be understood from the description thus far made, the outer surface of the intermediate ring 2 and the inner surface of the base 4 which define the channel are simple in geometry. Therefore, these surfaces can be finished accurately even with a lathe. Of course, it is easy to polish these surfaces specularly. Since the outer surface of the flange ring 1 and the inner surface of the intermediate ring 2 are inclined, the ring 1 expands the ring 2 uniformly over the whole inner surface of the ring 2, pressing the spacer against the inner wall of the base. Therefore, a desired seal pressure can be readily obtained. Also, a uniform pressure can be applied to the spacer over the whole length of the spacer.

Especially in the above example, the column base is equipped with the O-rings to enhance the effect of the seal. The inlet and outlet ports through which fluid flows into and out of the channel can be accurately located, because the spacer 3 is fixed to the intermediate ring 2. This eliminates the possibility that fluid leaks directly from the inlet port into the outlet port. Furthermore, the width of the channel can be set to any desired value by replacing the spacer 3 with another spacer of a different thickness and the ring with another appropriate ring.

Referring next to FIGS. 6–9, there is shown another column according to the invention. This column comprises a tightening top ring 31, an intermediate ring 2 having a variable diameter, a spacer 3 similar to the spacer 3 shown in FIGS. 2–4, an annular member 47, and a column base 34. The intermediate ring 2 is similar to intermediate ring 2 shown in FIGS. 2–4.

Figure 8:
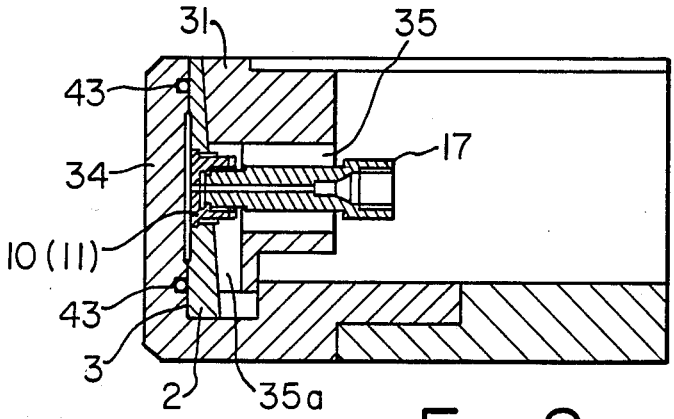

The top ring 31 is so machined that the width of the wall decreases downwardly and that the outer periphery is inclined. The top ring 31 is provided with two holes 35 in which connectors 17 are inserted. A plurality of threaded holes 36 extend vertically through the top ring 31. As shown in FIG. 8, the outer periphery of the top ring 31 has a cutout portion **35*a* which is in communication with the holes 35 to permit the insertion of an inlet tube 10 and an outlet tube 11. The height of the cutout portion 35*a* is less than the height of the top ring 31. The depth of the cutout portion 35*a* is slightly larger than the length of the inlet tube 10 and the outlet tube 11. The length of the tubes 10 and 11 is smaller than the thickness of the top ring 31**.

The annular member 47 is made of a sheet of polyimide having a thickness of 125 μm, for example. One side of the sheet is coated with Teflon to a thickness of 25 μm. This sheet is longer than the spacer 3. During the assembly, the sheet is cut to an appropriate length.

The column base 34 consists of a cylindrical container having a bottom, and holds the top ring 31, the intermediate ring 2, the spacer 3, and the annular member 47 therein. The base 34 is made of stainless steel. The inner surface of the base 34 is polished specularly. A pair of grooves 43 is formed in the inner surface of the base 34. The grooves 43 are spaced from each other, and extend parallel. The annular member 47 slightly enters the grooves 43, resulting in distinctive seal lands. The grooves 15 for receiving the O-rings shown in FIG. 2 can be used as the grooves 43. Corresponding to the threaded holes 36 formed in the top ring 31, a plurality of threaded holes 42 are formed in the bottom of the base 34.

The column shown in FIGS. 6–9 is assembled in the manner described below. First, the spacer 3 is wound around the outer periphery of the intermediate ring 2. The annular member 47 is wound on the spacer 3 in such a way that the coating may be in contact with the spacer 3. Screws are inserted into the recesses 12 to fasten one end of each component. The annular member 47 is longer than the spacer 3 as mentioned above. The superfluous portion of the annular member 47 which is not fastened is drawn inside the intermediate ring 2 through the slot 9 in the ring 2.

Then, the ring 2 on which the spacer 3 and the annular member 47 have been wound is inserted into the base 34. At this time, the ring 2 is compressed to reduce its diameter, for facilitating the insertion of the ring 2. Thereafter, the end of the annular member 47 which has been placed inside the ring 2 is pulled to make the annular member 47 taut. Subsequently, the superfluous portion of the annular member is cut off.

Figure 7:
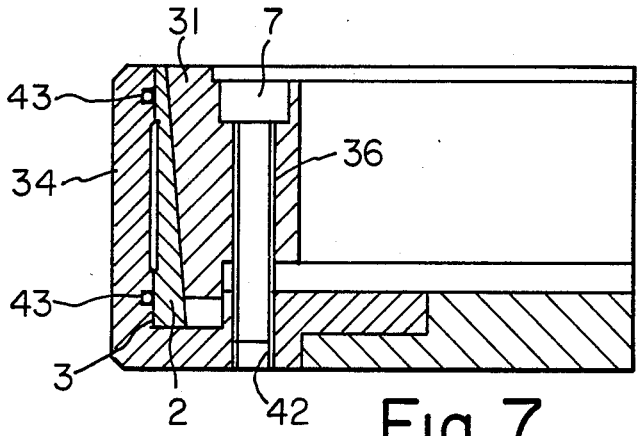
FIGS. 7 and 8 are fragmentary vertical cross sections of the column shown in FIG. 6.

The top ring 31 is then placed inside the intermediate ring 2. At this time, the inlet tube 10 and the outlet tube 11 pass across the cutout portion 35a and arrive at the positions of the holes 35. Then, as shown in FIG. 7, the top ring 31 and the base 34 are tightened together with the bolts 7. At this time, the inclined surface of the top ring 31 moves downwardly along the inclined surface of the intermediate ring 2. As a result, the ring 2 is expanded by the top ring 31 that acts like a wedge. The outer periphery of the intermediate ring 2 is pressed against the base 34 sandwiching the spacer 3 and the annular member 47 between them. Finally, as shown in FIG. 8, the connectors 17 are connected to the inlet tube 10 and the outlet tube 11.

Figure 9:
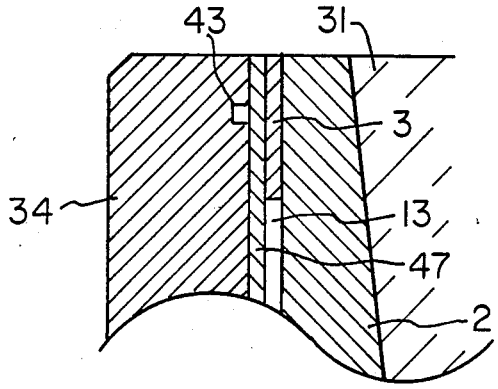
FIG. 9 is an enlarged cross section of a portion of the column shown in FIG. 6, for showing a channel formed after the column has been assembled.

After the column has been assembled in this way, the spacer 3 and the annular member 47 are sandwiched between the intermediate ring 2 and the base 34, as shown in FIG. 9. The portion of the cutout portion 13 of the spacer 3 that is surrounded by the outer periphery of the ring and the coated surface of the annular member 47 is used as a channel in which fluid flows.

Figure 10:
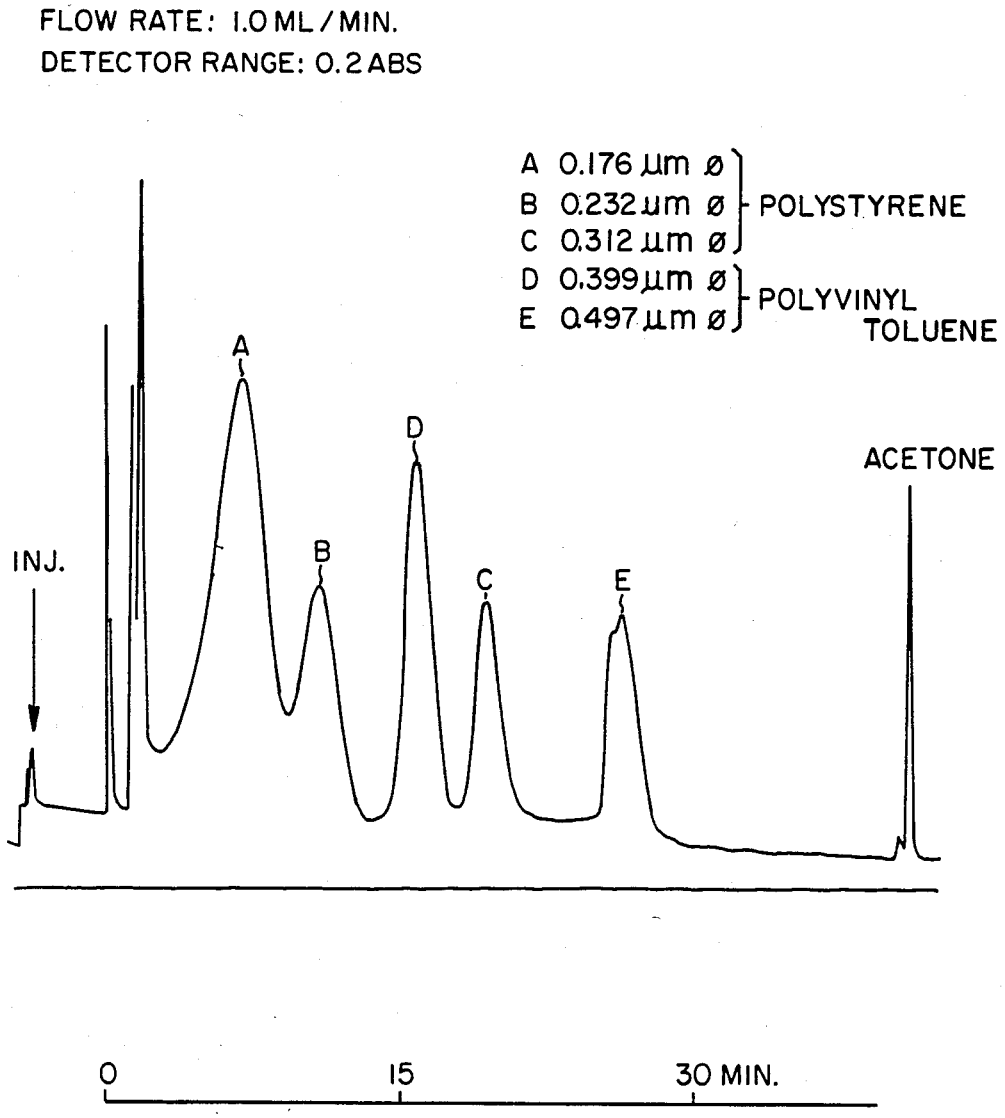
FIG. 10 is a diagram showing the result of a measurement made using the column shown in FIG. 6.

Particles of polystylene latex having diameters of 0.176 μm, 0.232 μm, and 0.312 μm were mixed with particles of polyvinyl toluene latex having diameters of 0.399 μm and 0.497 μm. The resulting mixture was analyzed with the column shown in FIG. 6. The result of the analysis is shown in FIG. 10. The analysis was made while keeping the rotational frequency at 1,800 rpm. Comparison of the graph of FIG. 10 with the graph of FIG. 5 reveals that the column shown in FIG. 6 can well separate particles more quickly than the column shown in FIG. 2 even in consideration of an effect for narrower channel width.

Figure 6:
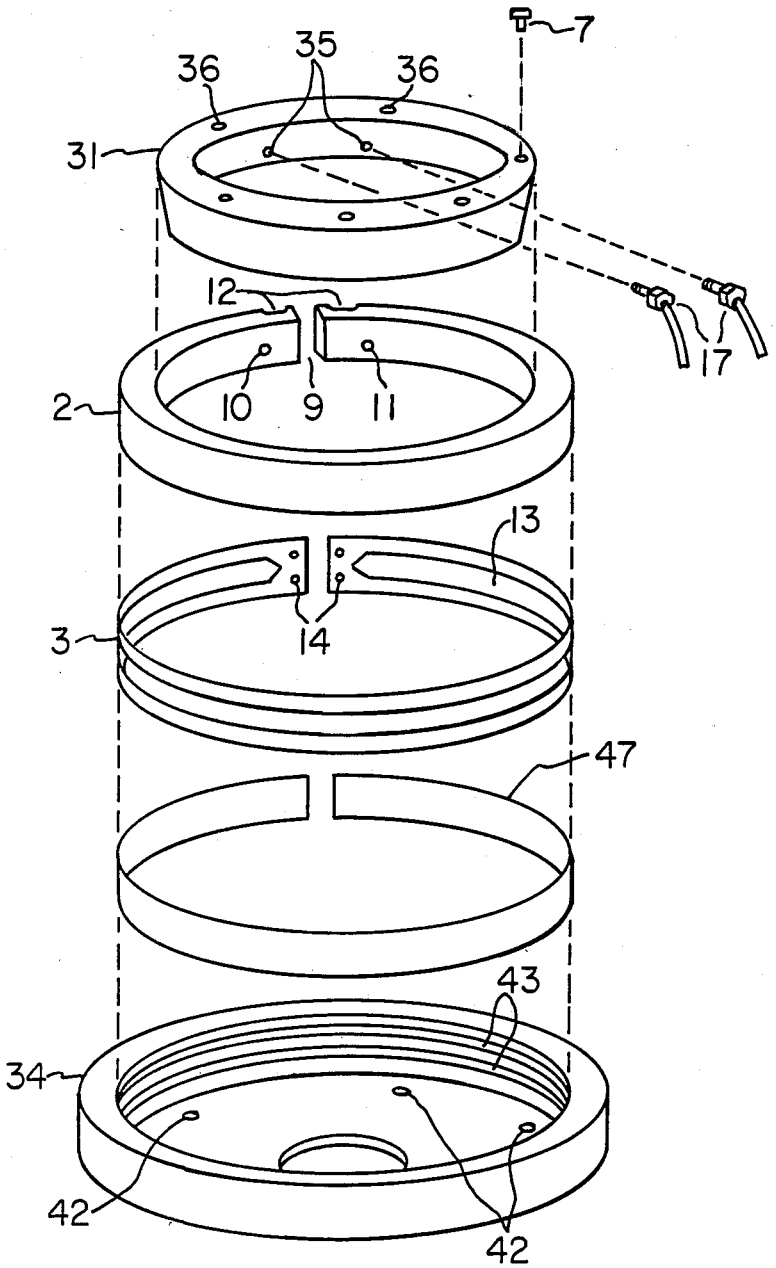
FIG. 6 is an exploded perspective view of another column according to the invention.

The column shown in FIG. 6 yields the following advantages in addition to the advantages obtained by the column shown in FIG. 2. The phenomenon occurring at the interface between the fluid flowing in the channel and the wall surface of the channel is greatly affected by the critical surface tension between the wall surface and the fluid. The present inventor has found that the performances of the separation column, especially the separative capacity per unit time, can be improved markedly by selecting the critical surface tension on the wall surface of the channel, especially on the accumulation wall, to be sufficiently smaller than the surface tension of the eluent flowing through the channel. Accordingly, it is desired that the material of the accumulation wall be selectable according to the kind of the eluent. In the above embodiment, such requirement can be very easily fulfilled by replacing the annular member 47 with another.

In the present embodiment, the top ring 31 is fixed to the bottom of the base 34, using the bolts 7. This allows a reduction in the thickness of the peripheral wall of the base 34, which in turn contributes to a decrease in the weight of the base 34. Additionally, the spacer 3 is more firmly fixed than the spacer 3 of the column shown in FIG. 2, because the height of the cutout portion **35*a* is smaller than the height of the top ring 31. Hence, the performance of the seal is enhanced. In the previous example shown in FIG. 2, the cutout portions 6 extend continuously to the lower end of the flanged ring 1**.

It is to be understood that the annular member 47 can be added to the column shown in FIG. 2. In this case, the addition of the annular member 47 also yields the aforementioned advantages.

Having thus described the invention with the detail and particularly required by the Patent Laws; what is claimed and desired to be protected by Letters Patents is set forth in the following claims.

What is claimed:

1. Apparatus defining a column for use in continuous particle fractionation utilizing a centrifugal field comprising:

a column base constituting an outer frame having a cylindrical flange;

a variable diameter intermediate ring for being positioned within the cylindrical flange of the column base having an inclined inner surface, said ring being radially cut to form a circumferential slot;

a tightening ring for being positioned within the intermediate ring having an inclined outer surface, the inclined outer surface abutting the inclined inner surface of the intermediate ring to expand the intermediate ring;

a ribbon-like spacer having a cutout portion extending along its length, said spacer being captured between the cylindrical flange and the intermediate ring to thereby define the axial wall of an annular separation channel;

an inlet port and an outlet port which are formed in the intermediate ring near the slot to introduce and discharge fluid to said separation channel; and whereby when the tightening ring is forced into the intermediate ring the spacer is compressed between the intermediate ring and the cylindrical flange.

2. The column of claim 1, wherein said spacer is a sheet of plastic material.

3. The column of claim 2, wherein said spacer is a sheet of polyimide.

4. The column of claim 1, further including an annular member having a smooth surface, the annular member being inserted between the spacer and the inner wall of the cylindrical flange of the column base and extending over the whole length of the spacer such that the smooth surface is in contact with the spacer.

5. The column of claim 4, wherein said annular member consists of a sheet of plastic material.

6. The column of claim 5, wherein said annular member consists of a sheet of polyimide coated with Teflon.

* * * * *